US008910333B2

(12) United States Patent
Wu

(10) Patent No.: US 8,910,333 B2
(45) Date of Patent: Dec. 16, 2014

(54) CONTROL PANEL OF SICKBED HAVING A LIGHT SOURCE

(75) Inventor: Chou-Hsin Wu, New Taipei (TW)

(73) Assignee: Timotion Technology Co., Ltd., New Taipei (TW)

( * ) Notice: Subject to any disclaimer, the term of this patent is extended or adjusted under 35 U.S.C. 154(b) by 335 days.

(21) Appl. No.: 13/367,831

(22) Filed: Feb. 7, 2012

(65) Prior Publication Data

US 2013/0198959 A1 Aug. 8, 2013

(51) Int. Cl.
*A61G 7/018* (2006.01)
*F21V 33/00* (2006.01)

(52) U.S. Cl.
CPC ..... *F21V 33/0072* (2013.01); *A61G 7/018* (2013.01); *F21V 33/0012* (2013.01); *Y10S 5/905* (2013.01)
USPC ..... 5/658; 5/503.1; 5/616; 5/905; 362/130; 362/85

(58) Field of Classification Search
CPC ..... F21V 33/0012; A61G 7/018
USPC ..... 5/616, 503.1, 658, 905; 362/85, 130, 362/801, 127, 253
See application file for complete search history.

(56) References Cited

U.S. PATENT DOCUMENTS

| | | | | |
|---|---|---|---|---|
| 3,872,294 | A * | 3/1975 | O'Toole | 362/85 |
| 4,680,790 | A * | 7/1987 | Packard et al. | 379/432 |
| 5,400,230 | A * | 3/1995 | Nicoletti | 362/253 |
| 5,542,138 | A * | 8/1996 | Williams et al. | 5/658 |
| 6,481,688 | B1 * | 11/2002 | Welling et al. | 248/694 |
| 6,486,792 | B1 * | 11/2002 | Moster et al. | 340/4.11 |
| 8,104,117 | B2 * | 1/2012 | Heimbrock et al. | 5/425 |
| 8,456,286 | B2 * | 6/2013 | Schuman et al. | 340/286.07 |
| 2008/0235872 | A1 * | 10/2008 | Newkirk et al. | 5/600 |

FOREIGN PATENT DOCUMENTS

TW M427931 U 5/2012

OTHER PUBLICATIONS

Taiwan Official Action issued on Jun. 24, 2014.

* cited by examiner

*Primary Examiner* — Michael Trettel
(74) *Attorney, Agent, or Firm* — Chun-Ming Shih; HDLS IPR Services

(57) ABSTRACT

A control panel of a sickbed having a light source is disposed around a sickbed and includes a casing, a light module and a control module. The light module and the control module are provided on two opposite surfaces of the casing respectively. The control module is electrically connected to the light module for controlling the height of the sickbed and an ON/OFF state of the light module. The control panel of the present invention is used to adjust the height of the sickbed and also provides illumination, so that it really demonstrates practicability and convenience.

7 Claims, 5 Drawing Sheets

CONTROL PANEL OF SICKBED HAVING A LIGHT SOURCE

BACKGROUND OF THE INVENTION

1. Field of the Invention

The present invention relates to a control panel, and in particular to a control panel of a sickbed having a light source.

2. Description of Prior Art

Many people have been hospitalized to lie on a sickbed. A light switch is often provided on a wall of a sickroom in the upper-rear of a patient who lies on a sickbed in the sickroom. The light switch is used to control the ON/OFF of a lamp above the sickbed. A control panel is hung on the left or right edge of the sickbed at a position which the patient can reach with his/her hand. The patient, family members accompanying the patient or medical personnel can adjust the height of the respective portions of the sickbed by using such a control panel.

As for a patient who lies on the sickbed but cannot or does not want to get up, although the patient can touch the keys on the control panel by his/her hand to adjust the height of the respective portions of the sickbed. However, there is often a problem that the patient lying on the sickbed cannot reach the light switch on the wall easily. As a result, when the patient lying on the sickbed wants to turn on or off the lamp, the patient needs to ask someone for help.

On the other hand, the light source above the sickbed comprises a fluorescent lamp having a large illumination range and a night lamp having a small illumination range. If there are other patiens lie and sleep on the adjacent sickbed in the same sickroom, turning on the fluorescent lamp having a large illumination range above the sickbed will disturb other patients lying on the adjacent sickbed. However, only turning on the night lamp cannot provide sufficient illumination for reading books or doing works. Thus, at this time, the patient often feel dilemmatic.

If the control panel of the sickbed is also provided with a light source, it would be very convenient for the patient lying on the sickbed because the patient can turn on or off the light source easily and the position of the light source can be changed on demands. Therefore, the present Inventor aims to solve the above problems and achieve the desired effect.

SUMMARY OF THE INVENTION

The present invention is to provide a control panel of a sickbed having a light source, which is capable of controlling the height of the sickbed and also acts as a light source.

The present invention is to provide a control panel of a sickbed having a light source, disposed around a sickbed and including:

- a casing having a first surface and a second surface opposite to the first surface;
- a light module provided in the casing adjacent to the first surface; and
- a control module provided in the casing adjacent to the second surface, the control module being electrically connected to the light module for controlling the height of the sickbed and an ON/OFF state of the light module.

In comparison with prior art, the present invention has the following advantageous features.

In the control panel of the present invention, two opposite surfaces of the casing are provided with a light module and a control module respectively. Even though the patient lying on the sickbed cannot or does not want to get up, the patient can touch the control panel by himself/herself easily. If the patient wants to adjust the height of the respective portions of the sickbed, the patient only needs to press the keys of the control module on the control panel. If the patient wants to read books, writing or doing some works at night, the patient can press a key of the control module to control the ON/OFF state of the light module. In this way, the patient can get sufficient illumination without affecting other patients in the same sickroom. Therefore, the control panel of a sickbed having a light source according to the present invention can be operated easily and conveniently. Since the control panel of the present invention also acts as a light source, it really demonstrates practicability and convenience.

DETAILED DESCRIPTION OF THE INVENTION

The detailed description and technical contents of the present invention will become apparent with the following detailed description accompanied with related drawings. It is noteworthy to point out that the drawings is provided for the illustration purpose only, but not intended for limiting the scope of the present invention.

Figure 4:
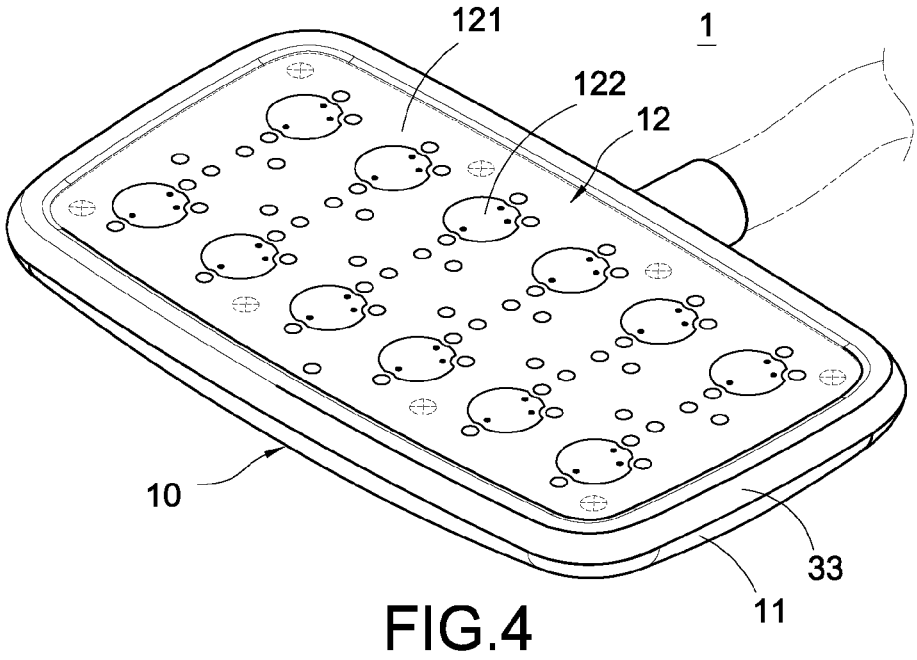
FIG. 4 is a perspective view showing the external appearance of the other surface of the present invention having the control module.
Figure 5:
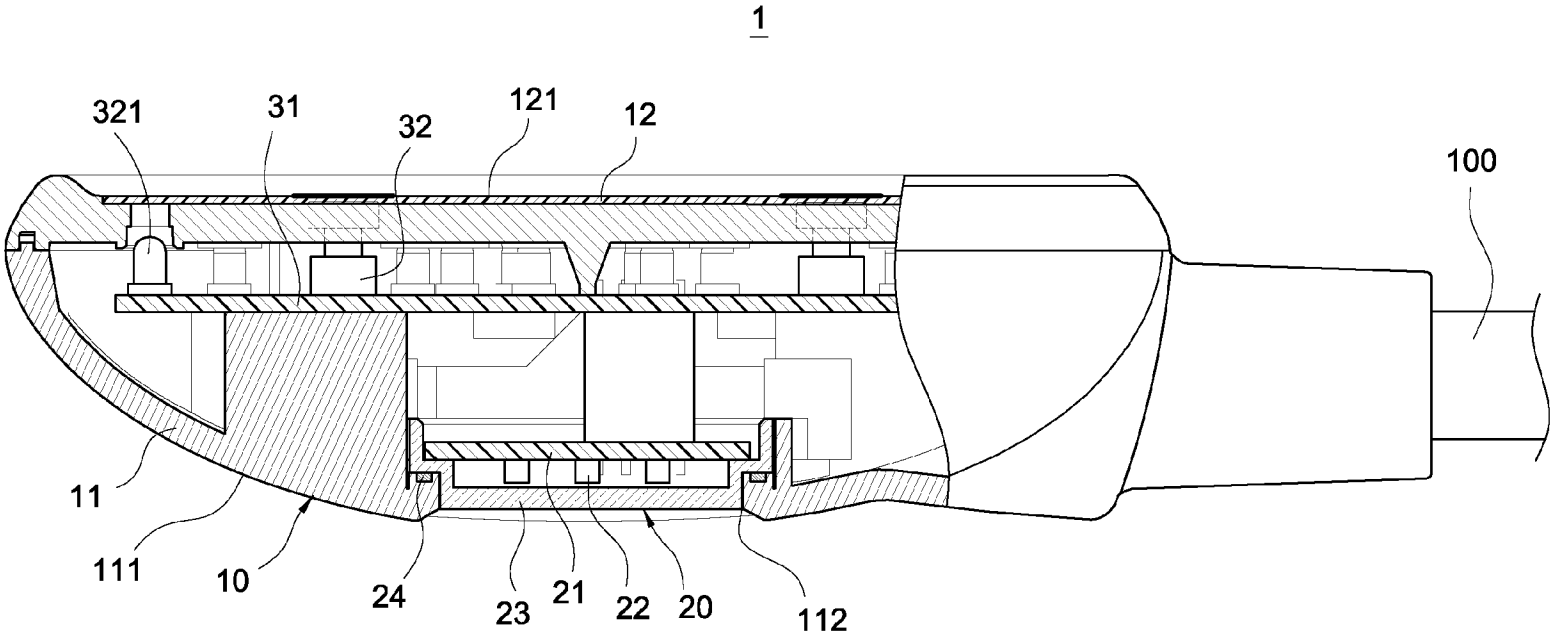
FIG. 5 is an assembled cross-sectional view of the present invention.
Figure 6:
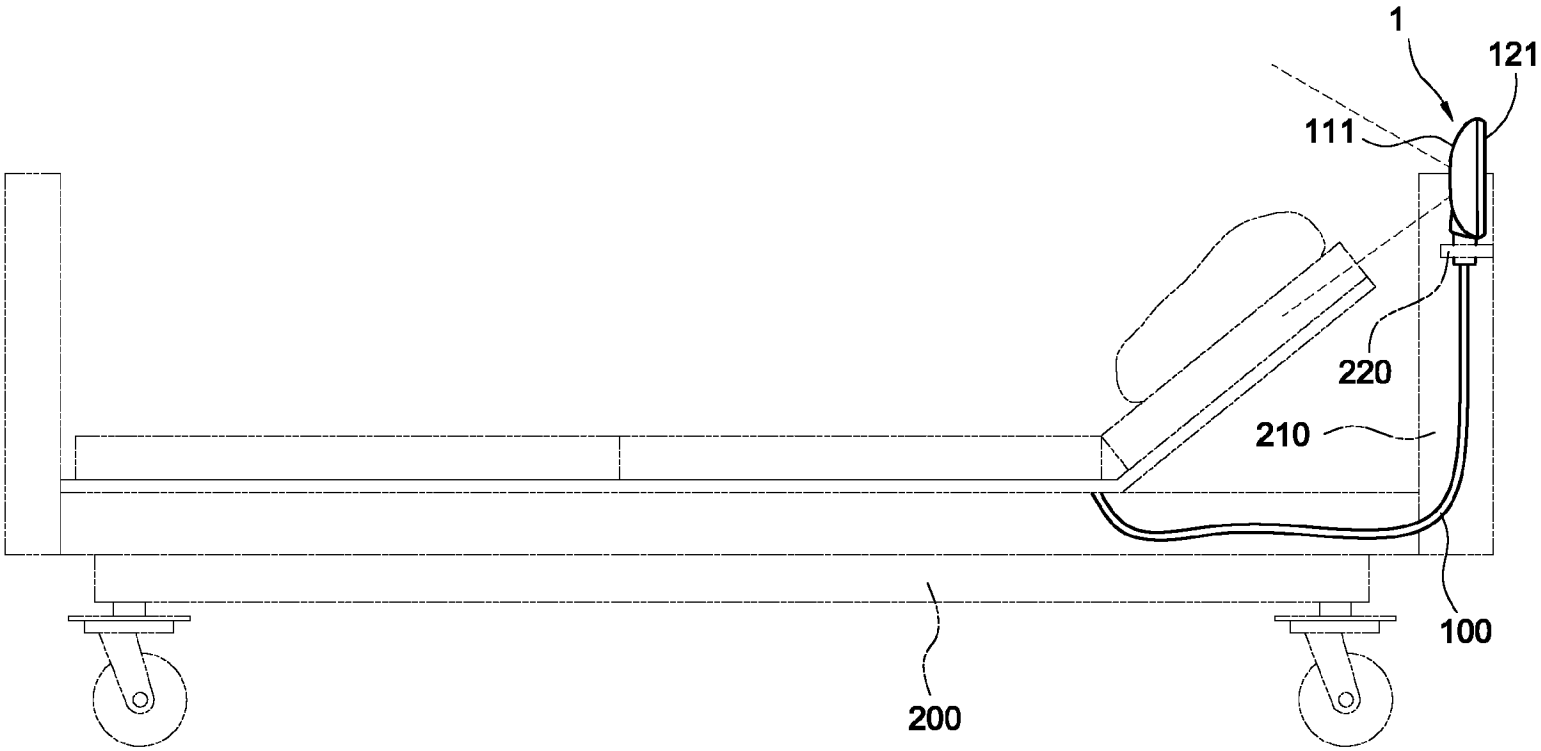
FIG. 6 is a schematic view showing the operating state of the present invention.

Please refer to FIGS. 1 to 6. The present invention relates to a control panel 1 of a sickbed having a light source. As shown in FIG. 6, the control panel 1 is provided around a sickbed 200 via a flexible telescopic power cable 100. The electrical connection between the flexible telescopic power cable 100 and the sickbed 200 belongs to prior art and is not the characteristic of the present invention, so that the description relating thereto is omitted for simplicity.

The control panel 1 of the present invention includes a casing 10, a light module 20 and a control module 30.

Figure 1:
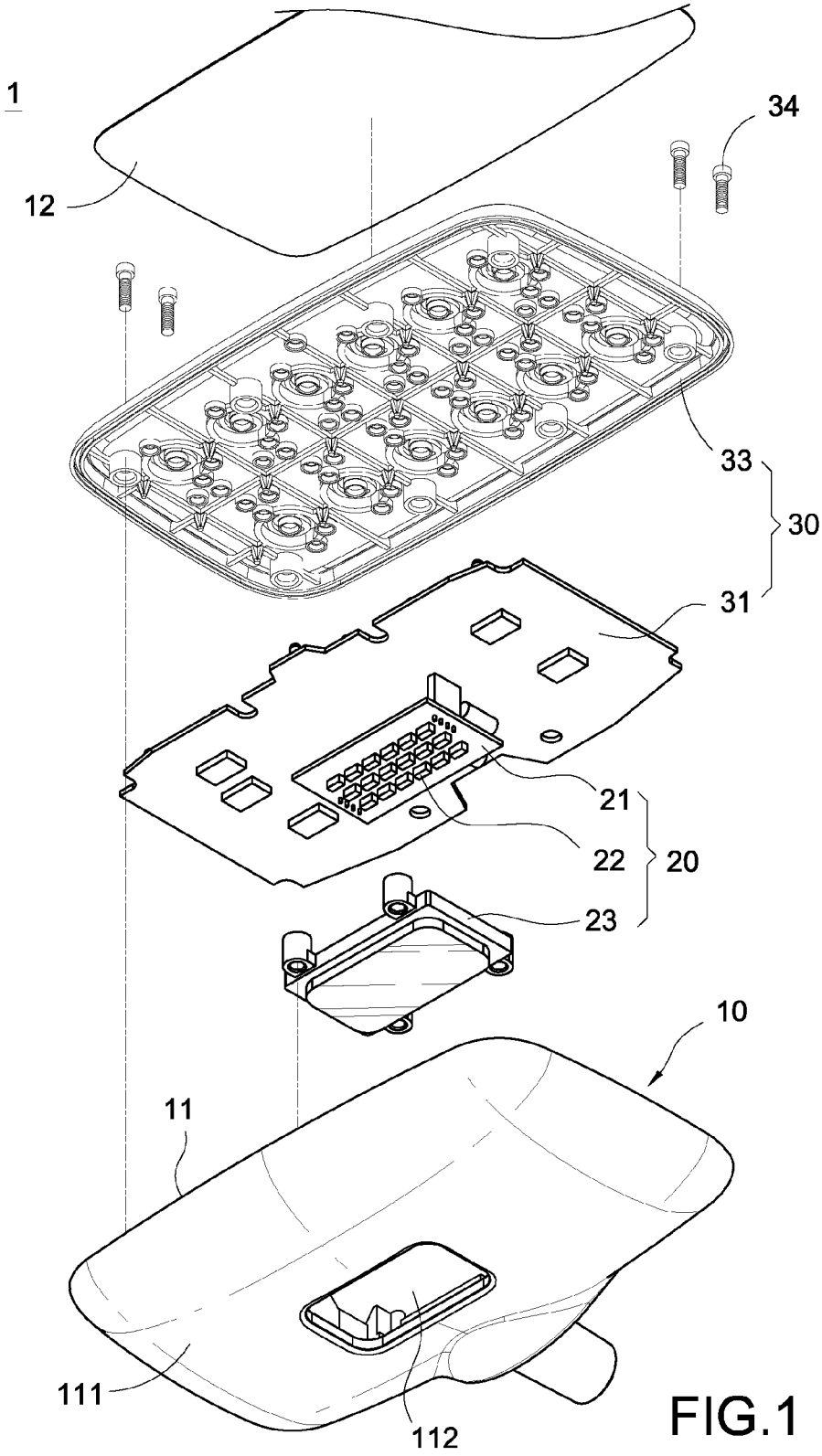
FIG. 1 is an exploded perspective view of the present invention.

As shown in FIG. 1, the casing 10 is constituted of a first cover 11 and a second cover 12. The casing 10 has a first surface 111 and a second surface 121 opposite to the first surface 111. The first surface 111 is located on the first cover 11. The second surface 121 is located on the second cover 12. The first surface 111 is further provided with an illumination opening 112.

Figure 3:
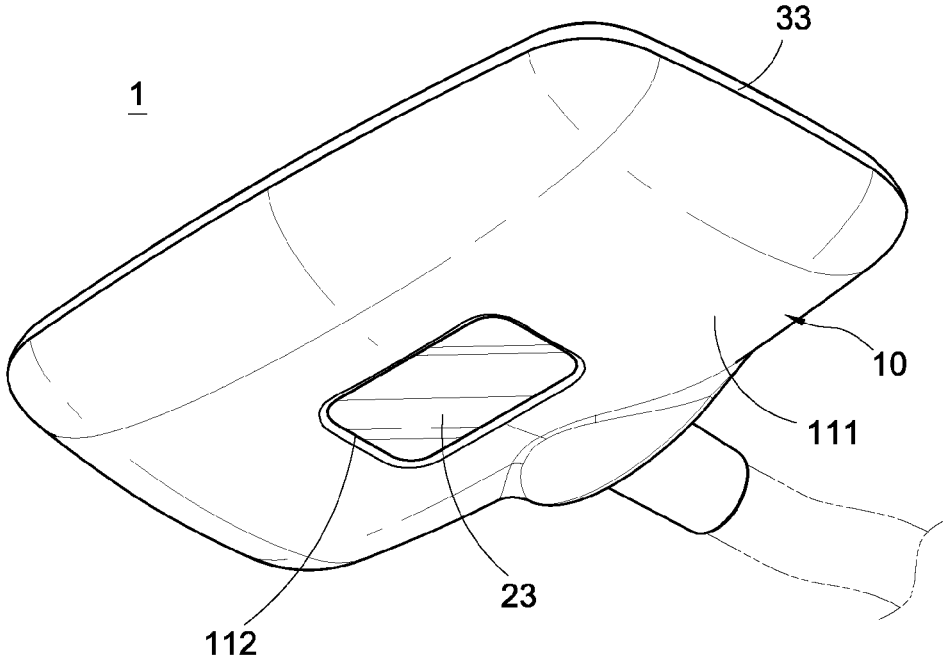
FIG. 3 is a perspective view showing the external appearance of one surface of the present invention having the light module.

The light module 20 is provided in the casing 10 adjacent to the first surface 111. The light module 20 includes a circuit board 21 and a plurality of light-emitting diodes 22 arranged on the circuit board 21 to face the illumination opening 112. In this way, the light emitted by the light-emitting diodes 22 can exit the illumination opening 112 for illumination. In order to protect the light-emitting diodes 22 from suffering damage due to external objects, a transparent shroud 23 is provided on the illumination opening 112. FIG. 3 shows the external appearance of the first surface 111 of the control panel 1.

Figure 2:
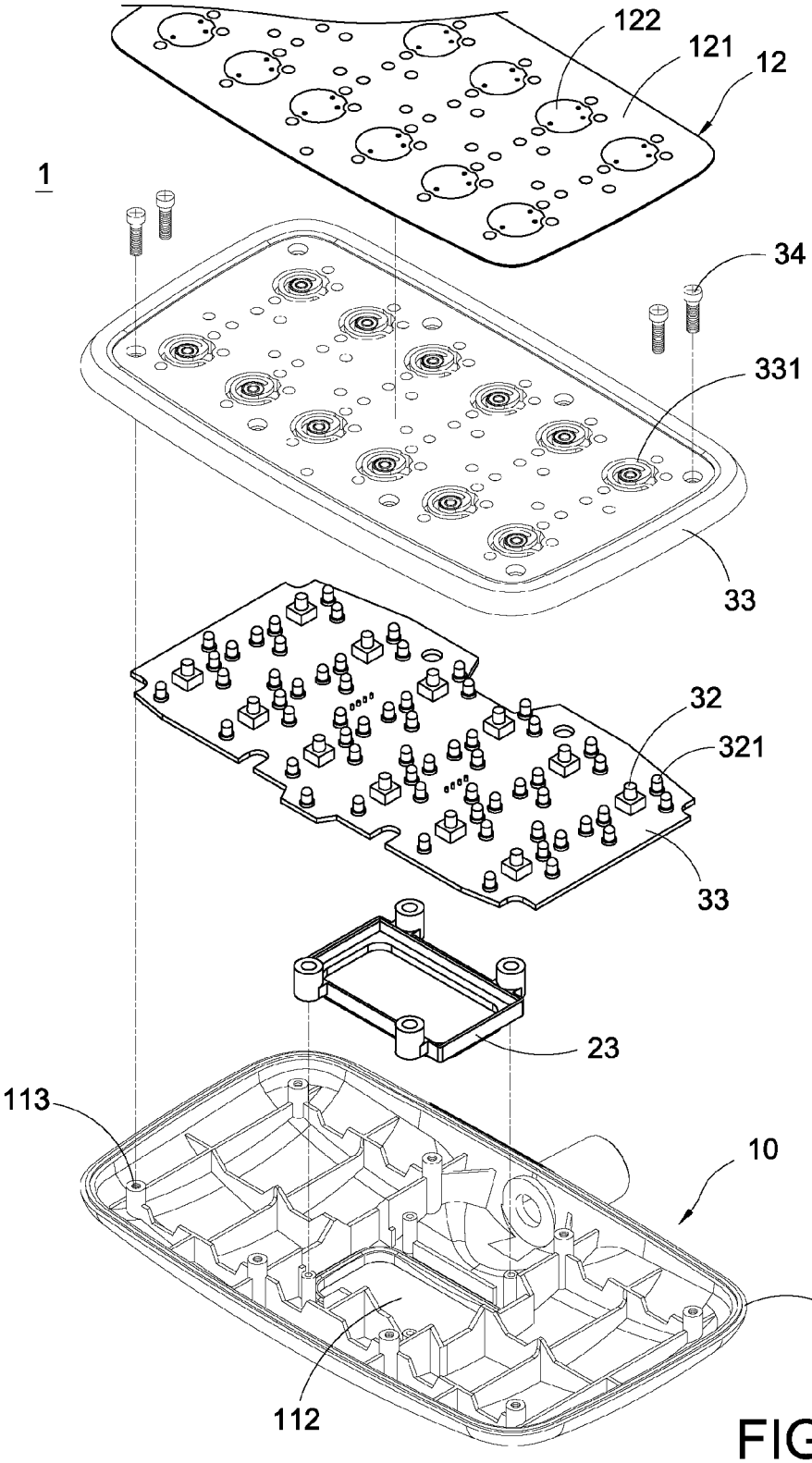
FIG. 2 is an exploded perspective view showing the control module of the present invention.

The control module 30 is provided in the casing 10 and is adjacent to the second surface 121. As shown in FIG. 2, the control module 30 comprises a circuit motherboard 31, a plurality of tactile switches 32 arranged on the circuit motherboard 31, and an elastic touch pad 33 adhered to the circuit motherboard 31 for activating the tactile switches 32. Four screws 34 are screwed into four screw holes 113 provided on inner surface of the first cover 11, thereby fastening the elastic touch pad 33 to the first cover 11. A plurality of indicators 321 are provided around each tactile switch 32 for displaying the ON/OFF state of the tactile switch 32. The surface of the elastic touch pad 33 is provided with a plurality of keys 331 at positions corresponding to those of the tactile switches 32.

Finally, the second cover 12 covers the elastic touch pad 33 to complete the assembly of the present invention. The second surface 121 of the second cover 12 is depicted with a plurality of patterns 122 at positions corresponding to those of the keys 331, so that the user can recognize the position of each tactile switch 32. FIG. 4 shows the external appearance of the second surface 121 of the control panel 1.

As shown in FIG. 1, the circuit motherboard 31 of the control module 30 is electrically connected to the circuit board 21 of the light module 20. Further, the flexible telescopic power cable 100 is disposed into the casing 10 to be electrically connected to the circuit motherboard 31 and the circuit board 21. By this arrangement, the control module 30 can control the height of the sickbed 200 and the ON/OFF state of the light module 20.

Please refer to FIG. 5. In order to prevent external moistures from entering the casing 10 via the illumination opening 112 to damage the electronic elements therein, an O-shaped sealing ring 24 is disposed around the transparent shroud 23.

Please refer to FIG. 6. In use, a hanging support 220 is provided on a bedplate 210 near the head of the patient. The control panel 1 of the present invention is hung on the hanging support 220, whereby the control panel 1 can provide illumination in the upper-rear of the patient. Alternatively, the outer surface of the control panel 1 of the present invention is formed with a hook (not shown), whereby the control panel 1 can be hung on the periphery of the sickbed 200. Since the position and length of the flexible telescopic power cable 100 can be adjusted freely, the user can put the control panel 1 at any suitable place where he/she can reach or where is to be illuminated. Thus, the present invention is very convenient in use.

In comparison with prior art, the present invention has the following advantageous features. In the control panel 1 of the present invention, two opposite surfaces 111 and 121 of the casing 10 are provided with a light module 20 and a control module 30 respectively. Even though the patient lying on the sickbed 200 cannot or does not want to get up, the patient can touch the control panel 1 by himself/herself easily. If the patient wants to adjust the height of the respective portions of the sickbed 200, the patient only needs to press the patterns 122 of the control module 30 on the control panel 1. The pressing force of the patient will penetrate the keys 331 of the elastic touch pad 33 to activate the tactile switches 32 under the elastic touch pad 33. If the patient wants to read books, writing or doing some works at night, the patient presses a key of the control module 30 to control the ON/OFF state of the light source 20. In this way, the patient can get sufficient illumination without affecting other patients in the same sickroom. Therefore, the control panel 1 of a sickbed having a light source according to the present invention can be operated easily and conveniently. Since the control panel 1 of the present invention also acts as a light source, it really demonstrates practicability and convenience.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A control panel (1) of a sickbed having a light source, disposed around a sickbed (200) for being used by patients, the control panel (1) including:

a casing (10) having a first surface (111) and a second surface (121) opposite to the first surface (111);

a light module (20) provided in the casing (10) adjacent to the first surface (111); and a control module (30) provided in the casing (10) adjacent to the second surface (121), the control module (30) being electrically connected to the light module (20) for controlling the height of the sickbed (200) and an ON/OFF state of the light module (20);

wherein the control panel (1) is disposed around the sickbed (200) via a flexible telescopic power cable (100), the flexible telescopic power cable (100) is electrically connected to the sickbed (200) and the control module (30), and the telescopic power cable (100) is extendable and capable of being twisted toward different directions;

wherein when in use, the control module (30) faces the patients, and the light module (20) is back to the patients.

2. The control panel (1) of a sickbed having a light source according to claim 1, wherein the casing (10) includes a first cover (11) and a second cover (12), the first surface (111) is provided on the first cover (11), the second surface (121) is provided on the second cover (12), the first surface (111) is further provided with an illumination opening (112) for allowing the light emitted by the light module (20) to exit.

3. The control panel (1) of a sickbed having a light source according to claim 2, wherein the light module (20) includes a circuit board (21) and a plurality of light-emitting diodes (22) arranged on the circuit board (21) to face the illumination opening (112).

4. The control panel (1) of a sickbed having a light source according to claim 3, wherein the light source (20) further includes a transparent shroud (23) at the illumination opening (112).

5. The control panel (1) of a sickbed having a light source according to claim 4, wherein an O-shaped sealing ring (24) is provided around the transparent shroud (23).

6. The control panel (1) of a sickbed having a light source according to claim 3, wherein the control module (30) comprises a circuit motherboard (31), a plurality of tactile switches (32) arranged on the circuit motherboard (31), and an elastic touch pad (33) adhered to the circuit motherboard (31) to activate the tactile switches (32), the elastic touch pad (33) being fastened inside the first cover (11), the second cover (12) covering the elastic touch pad (33).

7. The control panel (1) of a sickbed having a light source according to claim 6, wherein a surface of the elastic touch pad (33) is provided with a plurality of keys (331) at positions corresponding to those of the tactile switches (32), the second surface (121) of the second cover (12) being depicted with a plurality of patterns (122) at positions corresponding to those of the keys (331), a plurality of indicators (321) being provided around each tactile switch (32) for displaying an ON/OFF state of the tactile switch (32).

* * * * *